US008701921B2

(12) United States Patent
Acedo Morono

(10) Patent No.: US 8,701,921 B2
(45) Date of Patent: Apr. 22, 2014

(54) LOCKING ARRANGEMENT FOR A CONTAINER CLOSURE

(76) Inventor: Carlos Acedo Morono, Naucalpan (MX)

( * ) Notice: Subject to any disclaimer, the term of this patent is extended or adjusted under 35 U.S.C. 154(b) by 0 days.

(21) Appl. No.: 13/397,713

(22) Filed: Feb. 16, 2012

(65) Prior Publication Data

US 2012/0261378 A1 Oct. 18, 2012

(30) Foreign Application Priority Data

Feb. 25, 2011 (MX) ..... MX/a/2011/002176

(51) Int. Cl.
*B65D 41/06* (2006.01)

(52) U.S. Cl.
USPC ..... 220/300; 220/784; 220/293; 215/216; 215/331; 215/43

(58) Field of Classification Search
USPC ..... 215/216, 334, 222, 318, 331, 43, 321, 215/317, 339, 295; 220/784, 786, 298, 300, 220/301, 293
See application file for complete search history.

(56) References Cited

U.S. PATENT DOCUMENTS

| | | | | |
|---|---|---|---|---|
| 3,127,049 | A * | 3/1964 | Welty et al. | 220/301 |
| 5,449,077 | A * | 9/1995 | Seidler | 215/216 |
| 6,378,713 | B2 * | 4/2002 | Montgomery | 215/222 |
| 6,536,617 | B2 * | 3/2003 | White et al. | 215/320 |
| 7,387,214 | B1 * | 6/2008 | Shingle | 215/222 |
| 7,673,763 | B1 * | 3/2010 | Oh | 215/332 |
| 8,240,491 | B2 * | 8/2012 | Beecroft et al. | 215/216 |
| 2005/0145629 | A1 * | 7/2005 | Herr | 220/293 |
| 2011/0056948 | A1 * | 3/2011 | Brennan | 220/301 |

FOREIGN PATENT DOCUMENTS

| | | |
|---|---|---|
| MX | 171278 B | 10/1993 |
| MX | 2010003933 A | 11/2010 |

* cited by examiner

*Primary Examiner* — Steven A. Reynolds
*Assistant Examiner* — Javier A Pagan
(74) *Attorney, Agent, or Firm* — H. Frederick Rusche; Husch Blackwell LLP

(57) ABSTRACT

A closure system for a container includes a pair of primary anchors located opposite one another on an exterior surface of the neck. Each primary anchor has vertical and horizontal portions. A cap has an upper surface and a series of walls depending downwardly therefrom and at least first and second locking tabs extending downwardly from an underside of the cap. The locking tabs are located opposite one another, and there is at least one rib between the walls of the cap and the locking tabs. Each of the locking tabs has an inwardly extending anchor tab on an inside surface thereof the locking tab. The anchor tabs are arranged to engage the primary anchors when the cap is engaged with the neck and turned relative to the container. The vertical portions of the primary anchors are arranged to positively stop further rotation of the cap relative to the container.

9 Claims, 5 Drawing Sheets

LOCKING ARRANGEMENT FOR A CONTAINER CLOSURE

CROSS REFERENCE

This application claims priority to Mexican Patent Application No. MX/a/2011/002176, filed Feb. 25, 2011, pursuant to 35 U.S.C. §119 and 37 C.F.R. 1.55. The foregoing Mexican patent application is hereby incorporated by reference in its entirety.

TECHNICAL FIELD OF THE INVENTION

The present invention relates generally to rigid plastic packaging, and more particularly, to an improved closure system for containers.

BACKGROUND OF THE INVENTION

To meet the needs of the consumer there are different types of locking systems that generally keep a product within a container. However, these systems do not comply with different functionality and security and are not designed to facilitate the use of the product by the consumer. One example of such a locking system, known as a "Snap on" container closure), is disclosed in Mexican Patent No. 171278 and is currently used for packaging products.

A common feature of this type of prior art container is that unlocking the cap from the container body requires the use of a large rotational force large, which may not safe be for the consumer and can cause the sudden release of the cap and therefore the total or partial loss of the product.

Another similar prior art product is an "anti-cap container with anti-rotation loss and misuse" (the cover is attached to the donut-shaped container), as described in Mexican Patent Application No. MX/a/2010/003933. This design aims to prevent loss of the cover and therefore the product that it contains. However, while it fulfills its primary function, most of the time the product is usually stored in the twist-off cap, causing a poor perception of content.

Therefore, it would be desirable to provide a locking or closure system for containers that maintains a secure closure of the container while being easier to open and avoiding spillage of product.

SUMMARY OF THE INVENTION

One aspect of the invention generally pertains to an improved closure system that facilitates opening and closing of a container.

Another aspect of the invention pertains to an improved closure system that provides for locking and unlocking of a container with a lower manual force requirement for operation.

In accordance with one or more of the above aspects of the invention, there is provided a closure system for a container having a neck includes a pair of primary anchors located opposite one another on an exterior surface of the neck. Each primary anchor has a vertical portion and a horizontal portion. A cap has an upper surface and a series of walls depending downwardly therefrom as well as at least first and second locking tabs extending downwardly from an underside of the cap. The locking tabs are located opposite one another, and there is at least one rib between the walls of the cap and the locking tabs. Each of the locking tabs has an inwardly extending anchor tab on an inside surface of the locking tab. The anchor tabs are arranged to engage the primary anchors when the cap is engaged with the neck and turned relative to the container. The vertical portions of the primary anchors are arranged to positively stop further rotation of the cap relative to the container.

These aspects are merely illustrative of the innumerable aspects associated with the present invention and should not be deemed as limiting in any manner. These and other aspects, features and advantages of the present invention will become apparent from the following detailed description when taken in conjunction with the referenced drawings.

BRIEF DESCRIPTION OF THE DRAWINGS

Reference is now made more particularly to the drawings, which illustrate the best presently known mode of carrying out the invention and wherein similar reference characters indicate the same parts throughout the views.

DETAILED DESCRIPTION

In the following detailed description numerous specific details are set forth in order to provide a thorough understanding of the invention. However, it will be understood by those skilled in the art that the present invention may be practiced without these specific details. For example, the invention is not limited in scope to the particular type of industry application depicted in the figures. In other instances, well-known methods, procedures, and components have not been described in detail so as not to obscure the present invention.

Figure 1:
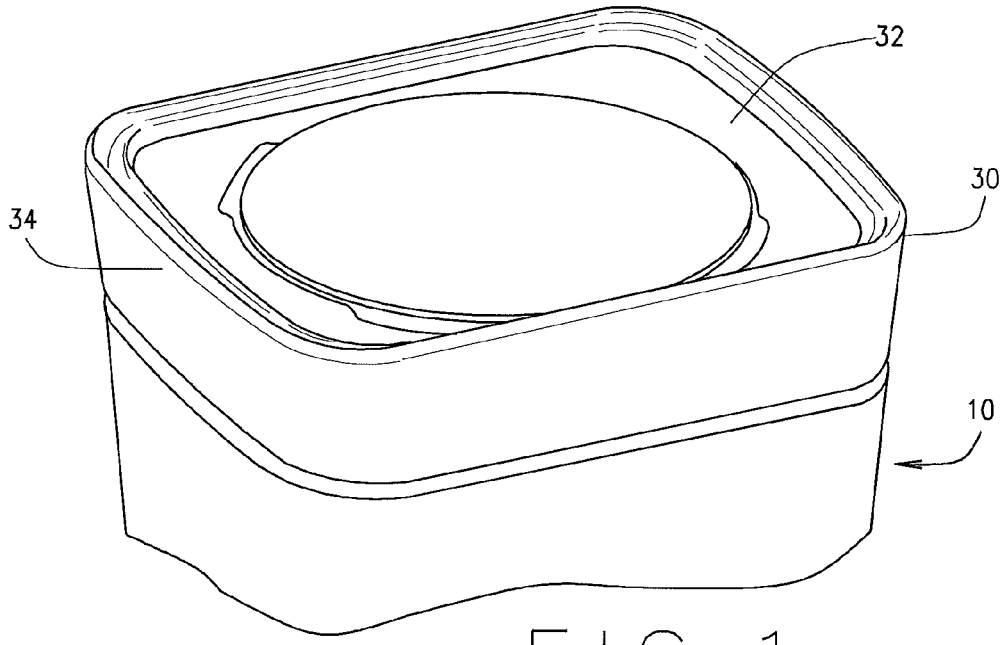
FIG. 1 is a perspective view of a closure system for a container according to an embodiment of the present invention in which the exterior surface of the closure is partially removed to illustrate the structures within the system.
Figure 2:
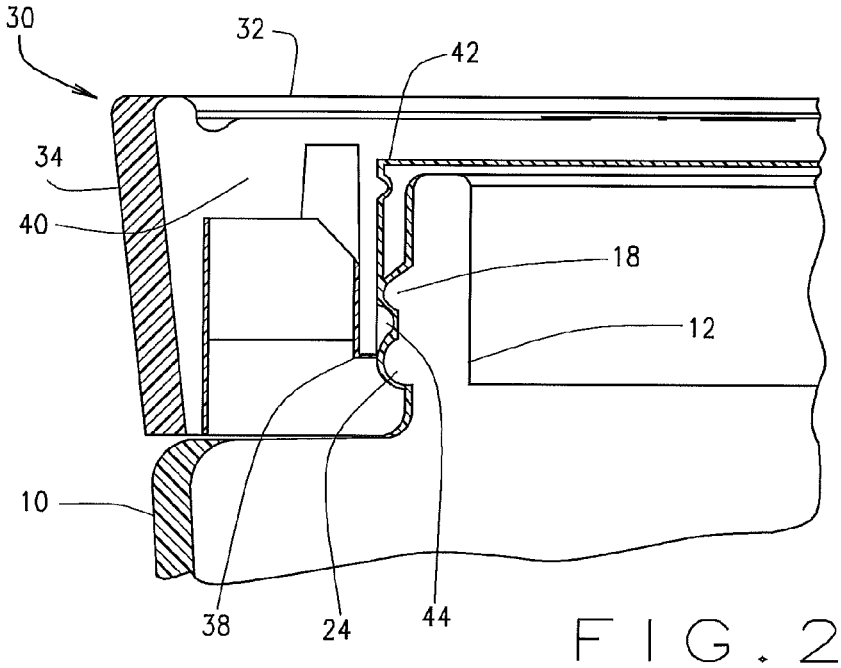
FIG. 2 is a partial cross-sectional view of the closure system of FIG. 1.
Figure 3:
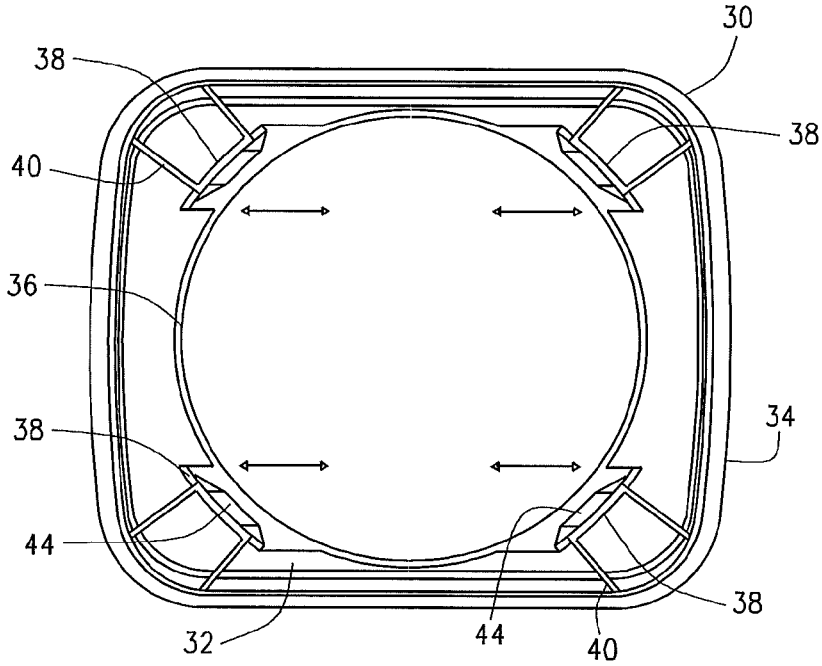
FIG. 3 is a bottom view of a cap for a closure system according to another embodiment of the invention.
Figure 4:
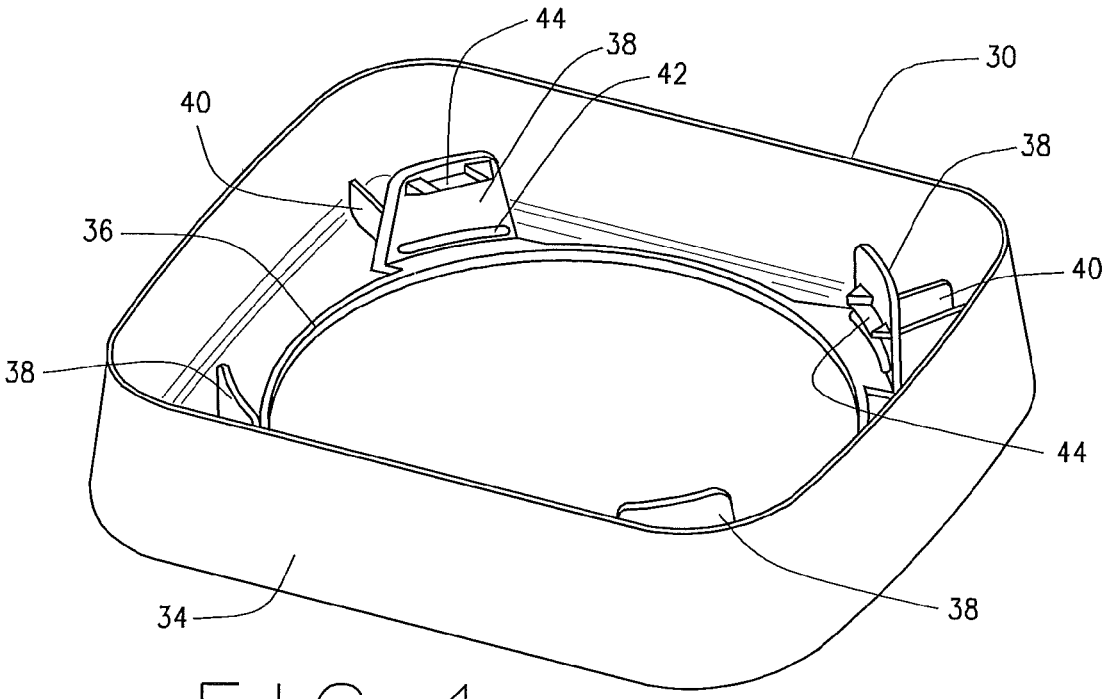
FIG. 4 is a perspective view of the underside of a cap for a closure system according to an embodiment of the invention.
Figure 5:
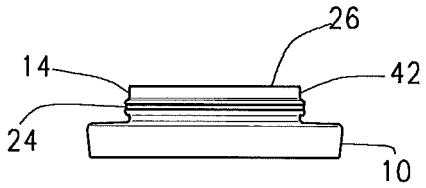
FIG. 5 is a partial side view of the upper portion of a container for use with a closure system according an embodiment of the invention.
Figure 6:
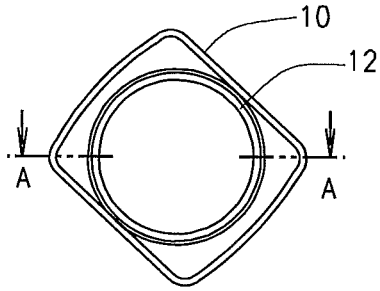
FIG. 6 is a top view of the container of FIG. 5.
Figure 7:
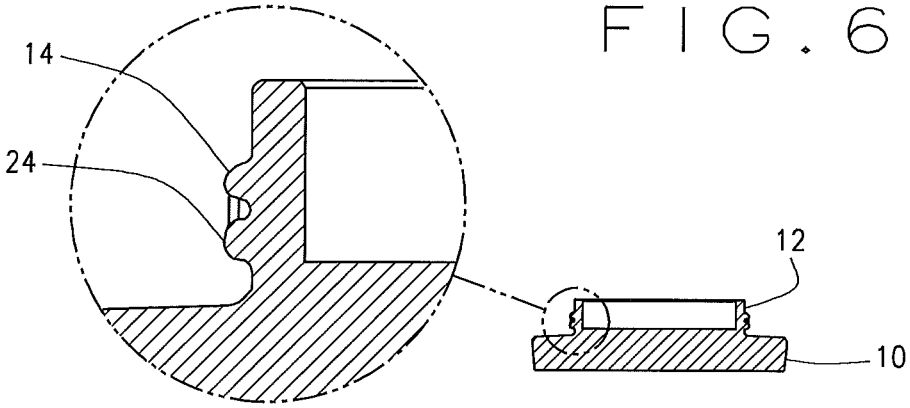
FIG. 7 is cross-sectional view of the container of FIGS. 5 and 6 taken along the line A-A in FIG. 6 and including an enlargement of a portion thereof.
Figure 8:
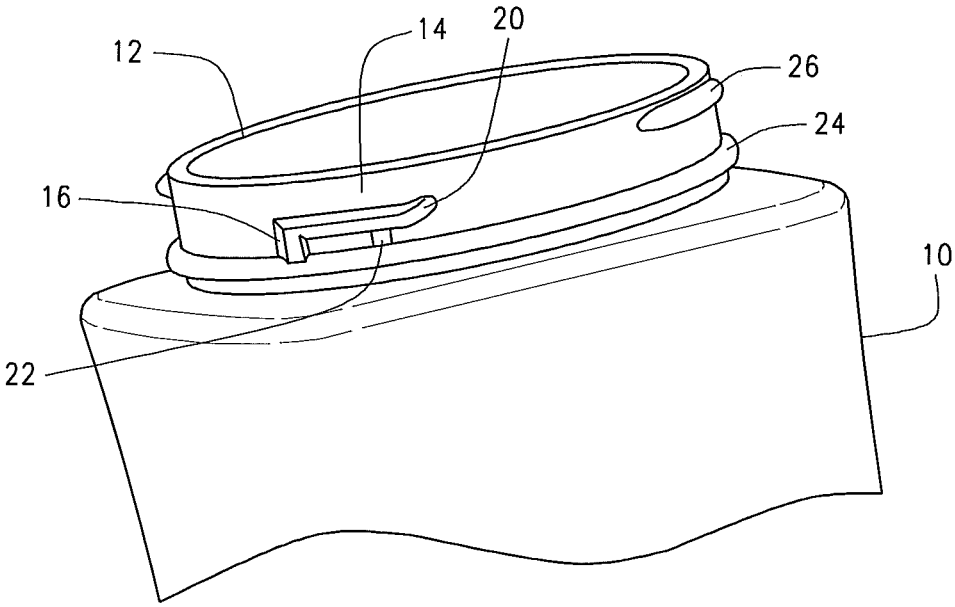
FIG. 8 is a perspective view of the upper portion of a container for use with a closure system according an embodiment of the invention.
Figure 9:
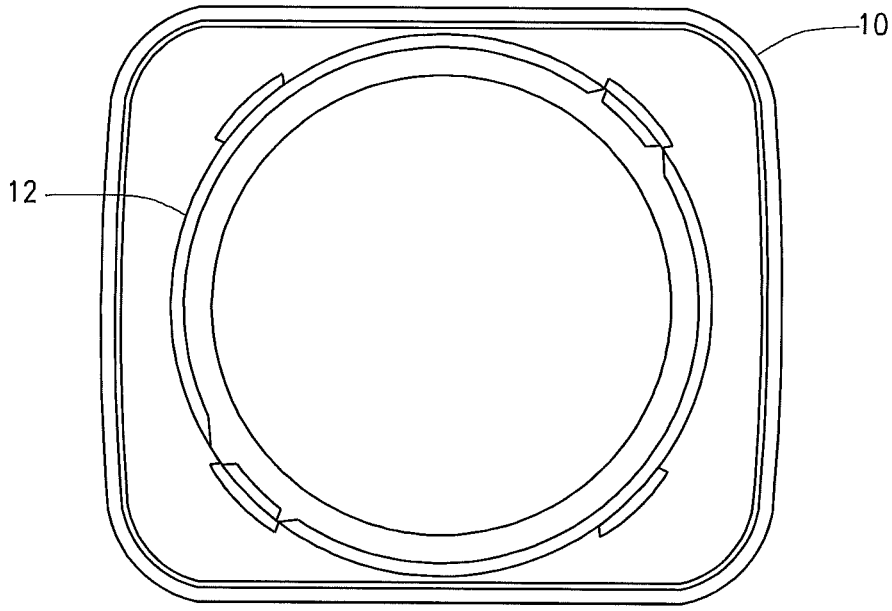
FIG. 9 is a top view of a container for use with a closure system according to an embodiment of the invention.
Figure 10:
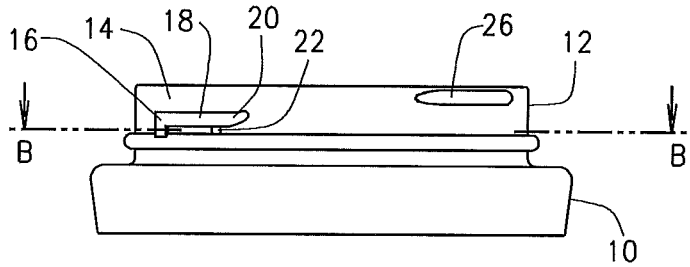
FIG. 10 is a side view of a container for use with a closure system according to an embodiment of the invention.
Figure 11:
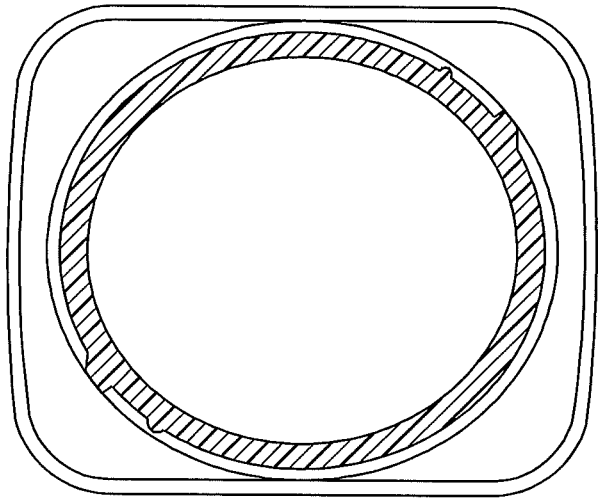
FIG. 11 is a cross-sectional view of the container of FIG. 10 taken along the line B-B.
Figure 12:
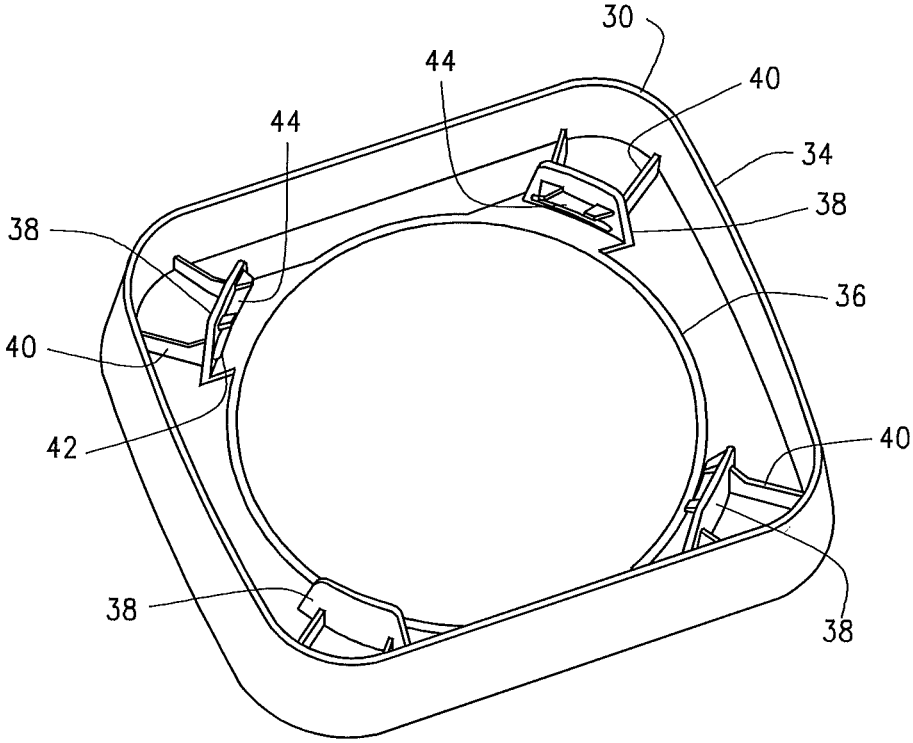
FIG. 12 is a perspective view of the underside of a cap for a closure system.

FIGS. 1-12 illustrate embodiments of a closure system for a container. The closure system is characterized by security locks and retention of the seal that allows for better sealing. These security locks are specially designed for holding the container, which consists of a special crown. This mechanism has anchor tabs on both sides and a bay, which is responsible for maintaining the seal in its original position even after the container has been opened.

When the lock is turned eyelashes anchor whose main function is to stop in the correct position, thus securing the tabs to fit properly into the bottle. All dimensions of the crown of the bottle is important, but this dimension is critical for setting the cap, it should be noted that the most important part of this dimension is the tolerance range, so we keep it as tight as possible. This system also has clamping ribs that spring into action to make the mechanism possesses excellent flexibility.

In the embodiment of FIGS. 1-12, there is shown a container 10, which may be made of glass, plastic, or any other desired material. The body of the container 10 may have any shape. However, in the preferred embodiment, the container 10 will transition from the body to a circular neck 12. The features of the neck 12 are best shown in FIGS. 2, 5-8, and 10. It will be seen that the neck 12 includes a pair of primary anchors 14. The primary anchors 14 are positioned approximately 180° from one another around the perimeter of the neck 12. Each primary anchor 14 includes a vertical portion 16 and a horizontal portion 18. In general, the horizontal portion 18 of the primary anchors 14 will be somewhat longer than the vertical portion 16. The vertical 16 and horizontal 18 portions of each primary anchor 14 form a roughly "L" shaped structure. Further, the horizontal portion 18 has an end section 20 that angles slightly upward relative to the rest of the primary anchor 14. While the vertical positioning of the primary anchors 14 on the neck 12 of the container 10 may vary to some degree, in a preferred embodiment, the primary anchors 14 are located at roughly the vertical midpoint of the neck 12.

It will also be seen that the primary anchors 14 each include a locking lug 22 that extends downwardly from the horizontal portion 18 of the primary anchor 14 adjacent to the end section 20. While the vertical 16 and horizontal 18 portions of the primary anchors 14 have essentially similar depths relative to the exterior surface of the neck 12, the locking lugs 22 have a lesser depth for reasons that will discussed in more detail.

Below the primary anchors 14, a continuous bead 24 runs along the perimeter of the neck 12. The continuous bead 24 has a depth relative to the exterior surface of the neck 12 that is similar to that of the vertical 16 and horizontal 16 portions of the primary anchors 14. It can be seen from the figures that the combination of the continuous bead 24 and the horizontal portion 18 of the primary anchors 14 form a groove, with the vertical portion 16 of the primary anchors 14 closing off one end of the groove.

The neck 12 also has a pair of secondary anchors 26 that are also positioned approximately 180° from one another around the perimeter of the neck 12. In addition, each secondary anchor 26 is positioned approximately 90° from each primary anchor. In total, the primary 14 and secondary 26 anchors alternate around the perimeter of the neck 12 of the container 10 at the 90°, 180°, 270°, and 360° positions. The secondary anchors 26 of the illustrated embodiment have a linear structure with a depth relative to the exterior surface of the neck 12 that is approximately the same as that of the vertical 16 and horizontal 18 portions of the primary anchors 14.

A coordinating cap 30 is also provided. The cap 30 includes an upper surface 32 with a series of downwardly depending walls 34. In the illustrated embodiment, the cap 30 has a roughly rectangular shape. On the underside of the upper surface 32 there is provided a circular bay 36. Surrounding the bay 36 are a series of four, generally vertical locking tabs 38. Extending between the locking tabs 38 and the corner portions of the walls 34 are multiple ribs 40. These ribs 40 provide resilient support for the locking tabs 38 and allow the cap to molded from plastic, even if the container 10 is made from a more rigid material such as a glass, while minimizing breakage of the locking tabs 38 from repeated opening and closing of the cap 30. In a preferred embodiment, the ribs 40 extend only between the lower portion of the locking tabs 38 and the walls 34, which allows the upper portions of the locking tabs 38 to flex more readily.

Each locking tab 38 is provided with two extensions on its inner surface. The first such extension, which is closer to the underside of the upper surface 32, is a seal retention tab 42. The seal retention tabs 42 on the four locking tabs 38 operate together to hold a foil seal (not shown) in place over the circular bay 36. When the cap 30 is secured to the container 10, the seal is pressed against the lip of the neck 12 to create a generally air-tight seal.

The second extension on the locking tabs 38 is an anchor tab 44. As can be seen particularly in FIG. 4, the anchor tabs 44 vary in their relative vertical positioning on the inner surface of the lacking tabs 38. More specifically, two of the anchor tabs 44 are positioned at approximately the vertical midpoint of their locking tabs 38 while the other two anchor tabs 44 are positioned closer to the upper end of their locking tabs 38. The locking tabs 38 are arranged such that the locking tabs 38 having the same structure are located directly opposite one another.

As can be seen generally from the figures, when the cap 30 is placed onto the neck 12 of the container 10 the locking tabs 38 having anchor tabs 44 at their vertical midpoint are intended to engage the secondary anchors 26. The locking tabs 38 having anchor tabs 44 at their upper ends are arranged to engage the primary anchors 14. With respect to each of the locking tabs 38, the anchor tabs 44 slide underneath the horizontal portions of the primary 14 and secondary 26 anchors to pull the cap 30 tightly down onto the neck 12 of the container 10 and engage the seal.

As the cap 30 is turned onto the neck 12, the anchor tabs 44 engaging the primary anchors 14 slide within the grooves defined by the circular bead 24 and horizontal portion 18. Further, those anchor tabs 44 are able to slide over the locking lugs 22 as the locking lugs 22 are shallower relative to the surface of the neck 12 as discussed above. This shallower depth, combined with the relative flexibility of the locking tabs 38, allows the anchor tabs 44 to pass over the locking lugs 22 as the cap 30 is rotated.

However, the anchor tabs 44 are not able to pass by the vertical portions 16 of the primary anchors 14. Thus, the vertical portions 16 serve as a positive stop to the rotation of the cap 30. In addition, the width of the anchor tabs 44 is advantageously slightly less than the distance between the vertical portion 16 and locking lug 22 of each primary anchor 14. Therefore, the anchor tabs 44 pass completely over the locking lug 22 just as they encounter the vertical portion 16 of the primary anchor 14. The locking tab 38, which has been slightly displaced by passing over the locking lug 22 is allowed to spring back to its original position, which positions the anchor tab 44 within the portion of the groove defined by the vertical 16 and horizontal 18 portions, the locking lug 22, and the circular bead 24. This secures the cap 30 in a sealed position.

In order to remove the cap 30 from the container 10, the cap 30 is rotated in the opposite direction. In order to allow such rotation, a slight amount of force must be applied to result in the slight deflection of the locking tabs 38 that are engaged with the primary anchors to allow the anchor tabs 44 on those locking tabs 38 to slide over the locking lugs 22. As the figures illustrate, the arrangement of the locking tabs 38 on the cap 30 and the primary 14 and secondary 26 anchors on the neck 12 of the container 10 ensure that only a quarter turn of rotation is required to secure the cap 30 onto the container 10 regardless of what position the cap 30 is initially engaged with the neck 12.

The preferred embodiments of the invention have been described above to explain the principles of the invention and its practical application to thereby enable others skilled in the art to utilize the invention in the best mode known to the inventors. However, as various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by the above-described exemplary embodiments, but should be defined only in accordance with the following claims appended hereto and their equivalents.

What is claimed is:

1. A closure system for a container having a neck, comprising:

a pair of primary anchors located opposite one another on an exterior surface of said neck, said primary anchors each further comprising a vertical portion and a horizontal portion;

a pair of secondary anchors located opposite one another on said exterior surface of said neck, each of said secondary anchors arranged approximately equidistant between said primary anchors, said secondary anchors comprising a horizontal portion;

a cap having an upper surface and a series of walls depending downwardly therefrom, said cap having first and second locking tabs extending downwardly from an underside of said upper surface of said cap, said locking tabs located opposite one another;

said cap having third and fourth locking tabs extending downwardly from an underside of said upper surface of said cap, said third and fourth locking tabs located opposite one another;

each of said locking tabs having an anchor tab on an inside surface of said locking tab, said anchor tab extending inwardly from said locking tab;

wherein said anchor tabs of said first and second locking tabs are arranged to engage said primary anchors upon engaging of said cap with said neck and turning said cap relative to said container and wherein said vertical portions of said primary anchors are arranged to positively stop further rotation of said cap relative to said container; and wherein said anchor tabs of said third and fourth locking tabs are arranged to engage said secondary anchors upon engaging of said cap with said neck and turning said cap relative to said container.

2. The closure system as set forth in claim 1, wherein each of said locking tabs comprises first and second ends and wherein said first end of said locking tabs is adjacent an underside of said upper surface of said cap and wherein said anchor tabs of said first and second locking tabs are arranged at a point adjacent said second ends of said first and second locking tabs.

3. The closure system as set forth in claim 1, wherein each of said locking tabs comprises first and second ends and wherein said first end of said locking tabs is adjacent an underside of said upper surface of said cap;

wherein said anchor tabs of said first and second locking tabs are arranged at a point adjacent said second ends of said first and second locking tabs; and wherein said anchor tabs of said third and fourth locking tabs are arranged at a point approximately equidistant between said first and second ends of said third and fourth locking tabs.

4. A closure system for a container having a neck, comprising:

a pair of primary anchors located opposite one another on an exterior surface of said neck, said primary anchors each further comprising a vertical portion and a horizontal portion;

a cap having an upper surface and a series of walls depending downwardly therefrom, said cap having first and second locking tabs extending downwardly from an underside of said upper surface of said cap, said locking tabs located opposite one another, wherein each of said locking tabs comprises first and second ends and wherein said first end of said locking tabs is adjacent an underside of said upper surface of said cap and wherein first and second locking tabs further comprise seal retention tabs extending inwardly from said locking tabs and located adjacent said first end of said locking tabs;

each of said locking tabs having an anchor tab on an inside surface of said locking tab, said anchor tab extending inwardly from said locking tab; and wherein said anchor tabs are arranged to engage said primary anchors upon engaging of said cap with said neck and turning said cap relative to said container and wherein said vertical portions of said primary anchors are arranged to positively stop further rotation of said cap relative to said container.

5. The closure system as set forth in claim 1, further comprising at least one rib extending outwardly from at least one of said first and second locking tab to one of said walls adjacent to said rib.

6. The closure system as set forth in claim 5, wherein said at least one rib has a height that is less than a height of said first and second locking tab.

7. The closure system as set forth in claim 5, wherein said at least one rib has a height that is no more than half of a height of said first and second locking tab.

8. The closure system as set forth in claim 1, wherein said cap, including said upper surface and said walls, and said locking tabs and anchor tabs are integrally molded to form a unitary piece.

9. The closure system as set forth in claim 1, wherein said end portion of said horizontal portion of said primary anchors further comprises a tapered section.

* * * * *